US010231509B2

(12) United States Patent
Bann et al.

(10) Patent No.: US 10,231,509 B2
(45) Date of Patent: Mar. 19, 2019

(54) ITEM OF FOOTWEAR

(71) Applicant: Name Drop SARL, Luxembourg (LU)

(72) Inventors: Kevin Bann, Burnley (GB); Robert Fleck, Tyne & Wear (GB)

(73) Assignee: FITFLOP LIMITED (GB)

( * ) Notice: Subject to any disclaimer, the term of this patent is extended or adjusted under 35 U.S.C. 154(b) by 0 days.

(21) Appl. No.: 14/892,680

(22) PCT Filed: May 21, 2014

(86) PCT No.: PCT/EP2014/060463
§ 371 (c)(1),
(2) Date: Nov. 20, 2015

(87) PCT Pub. No.: WO2014/187868
PCT Pub. Date: Nov. 27, 2014

(65) Prior Publication Data
US 2016/0100652 A1 Apr. 14, 2016

(30) Foreign Application Priority Data
May 21, 2013 (GB) ..... 1309164

(51) Int. Cl.
*A43B 7/14* (2006.01)
*A43B 7/28* (2006.01)
(Continued)

(52) U.S. Cl.
CPC ..... *A43B 7/28* (2013.01); *A43B 7/141* (2013.01); *A43B 7/142* (2013.01); *A43B 7/143* (2013.01);
(Continued)

(58) Field of Classification Search
CPC ..... A43B 7/1415; A43B 7/142; A43B 7/144; A43B 7/143; A43B 7/16; A43B 7/22
(Continued)

(56) References Cited

U.S. PATENT DOCUMENTS 2,379,000 A 6/1945 Gould
3,964,181 A 6/1976 Holcombe
(Continued)

FOREIGN PATENT DOCUMENTS

CH 607677 10/1978
DE 1800129 11/1959
(Continued)

OTHER PUBLICATIONS

UK Intellectual Property Office, Patents Act 1977 Combined Search and Examination Report Under Sections 17 & 18 (3).dated Nov. 22, 2013. 2 pages. UK.
(Continued)

*Primary Examiner* — Ted Kavanaugh
(74) *Attorney, Agent, or Firm* — Luedeka Neely Group, P.C.

(57) ABSTRACT

The present invention relates to an item of footwear comprising a sole with an upper surface having a concave rear portion and a forward portion that is flat in the lateral direction. An item of footwear comprises: a securing means for securing the item of footwear to a foot of a wearer; and a sole having an upper surface that in use contacts the foot of a user, wherein: the upper surface has a first portion (7) and a second portion (6), the first portion (7) located forwardly of the second portion (6); the upper surface is substantially flat in the lateral direction in the first portion (7); and the upper surface is concave in the lateral direction in the second portion (6).

14 Claims, 4 Drawing Sheets

(51) Int. Cl.
*A43B 13/12* (2006.01)
*A43B 13/18* (2006.01)

(52) U.S. Cl.
CPC ..... *A43B 7/144* (2013.01); *A43B 7/145* (2013.01); *A43B 7/1425* (2013.01); *A43B 7/1435* (2013.01); *A43B 7/1445* (2013.01); *A43B 13/125* (2013.01); *A43B 13/127* (2013.01); *A43B 13/187* (2013.01); *A43B 13/188* (2013.01)

(58) Field of Classification Search
USPC ..... 36/43, 44, 30 R, 11.5
See application file for complete search history.

(56) References Cited

U.S. PATENT DOCUMENTS

| | | | | | |
|---|---|---|---|---|---|
| 4,003,146 | A | | 1/1977 | Meier et al. | |
| 4,291,428 | A | * | 9/1981 | Anzani | A43B 13/41 12/146 B |
| 4,320,588 | A | * | 3/1982 | Sottolana | A43B 13/14 36/24.5 |
| 4,586,273 | A | * | 5/1986 | Chapnick | A43B 7/142 36/154 |
| 4,782,605 | A | * | 11/1988 | Chapnick | A43B 7/142 156/221 |
| 6,286,232 | B1 | * | 9/2001 | Snyder | A43B 7/142 36/142 |
| 6,578,290 | B1 | | 6/2003 | Meynard | |
| 2002/0056208 | A1 | * | 5/2002 | Brown | A43B 7/142 36/44 |
| 2003/0070321 | A1 | * | 4/2003 | Davis | A43B 7/144 36/43 |
| 2006/0277795 | A1 | * | 12/2006 | Baier | A43B 13/12 36/30 R |
| 2007/0186446 | A1 | * | 8/2007 | Lafortune | A43B 7/142 36/43 |
| 2011/0225852 | A1 | | 9/2011 | Mahoney | |
| 2013/0133224 | A1 | * | 5/2013 | Tsai | A43B 3/0063 36/43 |
| 2014/0259759 | A1 | * | 9/2014 | Sulak | A43B 7/148 36/44 |

FOREIGN PATENT DOCUMENTS

| | | |
|---|---|---|
| DE | 20 2007008016 | 8/2007 |
| EP | 0995364 | 4/2000 |
| GB | 2451739 | 2/2009 |
| GB | 2493036 | 1/2013 |
| WO | 2009067643 | 5/2009 |

OTHER PUBLICATIONS

UK Intellectual Property Office, Patents Act 1977: Search Report under Section 17. dated Nov. 21, 2013. 1 page. UK.
UK Intellectual Property Office, Patents Act 1977 Examination Report under Section 18(3). dated Aug. 19, 2014. 1 page UK.
UK Intellectual Property Office, Patents Act 1977 Examination Report under Section 18(3). dated Apr. 29, 2015. 1 page. UK.
European Patent Office, Angeliki Gkionaki, PCT International Search Report. dated Sep. 2, 2014. 4 pages. Europe.
European Patent Office, Angeliki Gkionaki, PCT Written Opinion of the International Searching Authority. 5 pages. Date not provided. Europe.

* cited by examiner

ITEM OF FOOTWEAR

The present invention relates to an item of footwear comprising a sole with an upper surface having a concave rear portion and a forward portion that is flat in the lateral direction.

Conventionally, a sole will be curved in the lateral direction over its entire length. The inventor has discovered that extra comfort can be achieved in an item of footwear if, as shown in FIG. 1, the sole or insole has a flat upper surface when viewed in a cross-section in the lateral direction. This is of particular importance below the metatarsals of the foot, i.e. in the region of the foot forward of the user's inner longitudinal arch. However, it is preferable to have a concave upper surface below the heel to adequately cushion and stabilise a user's gait.

It has been found that a sole or insole having a concave upper surface below a user's heel region, but an upper surface which is flat in the lateral direction below the user's metatarsal bones offers cushioning and support of the foot during a heel-strike (the point in a normal gait when the heel first touches the ground), whilst providing greater comfort for the wearer.

It has also been found that these features are enhanced when used in a sole having regions of differing density and/or flexibility and/or compressive resistance.

Accordingly, there is provided an item of footwear an item of footwear comprising: a securing means for securing the item of footwear to a foot of a wearer; and a sole having an upper surface that in use contacts the foot of a user, wherein: the upper surface has a first portion and a second portion, the first portion located forwardly of the second portion; the upper surface is substantially flat in the lateral direction in the first portion; and the upper surface is concave in the second portion.

In some embodiments the first portion may extend across the full width of the sole in the lateral direction.

Alternatively, there may be provided a wall protruding upwardly from the sole and extending around the perimeter of the sole, surrounding the first and second portions. The first portion may extend laterally either between opposing portions of the wall or all the way to the edge of the sole.

In preferred embodiments, the first portion is arranged to support the user's metatarsal bones and the second portion is arranged to support the user's heel.

In preferred embodiments, the first portion is substantially flat in the lateral direction such that the upper surface has a height in the first portion that is substantially constant in the lateral direction forwardly of the part of the sole corresponding to the foremost end of the user's inner longitudinal arch.

In preferred embodiments, the first portion is substantially flat in the lateral direction such that the foremost end of the user's inner longitudinal arch the upper surface is substantially flat in the first portion when viewed in a cross-section through the sole, the cross-section extending in a vertical plane and in the lateral direction.

In preferred embodiments, the first portion is substantially flat in the lateral direction such that the sole has a height that varies by less than 10% in the lateral direction in the region of the sole that supports the user's metatarsal bones. Preferably, the height of the sole varies by less than 1 mm in the lateral direction in the region of the sole that supports the user's metatarsal arch.

In preferred embodiments, the first portion is substantially flat in the lateral direction such that in a cross-section through the sole the edges of the first portion of the upper surface have a height that is within 10% of the height of the middle of the sole in the region of the sole that is forward of the foremost end of the user's inner longitudinal arch. Preferably, the edges of the upper surface of the first portion have a height that is within 1 mm of the height of the middle of the sole in the region of the sole that supports the user's metatarsal arch (that is, in the region extending between opposing portions of the wall, if provided).

Such a shaped upper surface can be part of a conventional, single density sole, or may be used in combination with a sole having two or more regions of variable density, such as those disclosed in: UK application no. 1119822.3 filed 16 Nov. 2011, UK application no. 1112362.7 filed 18 Jul. 2011, or WO2008/132478.

A preferred embodiment of the present invention will now be described, by way of example only, with reference to the accompanying drawings, in which.

Figure 2:
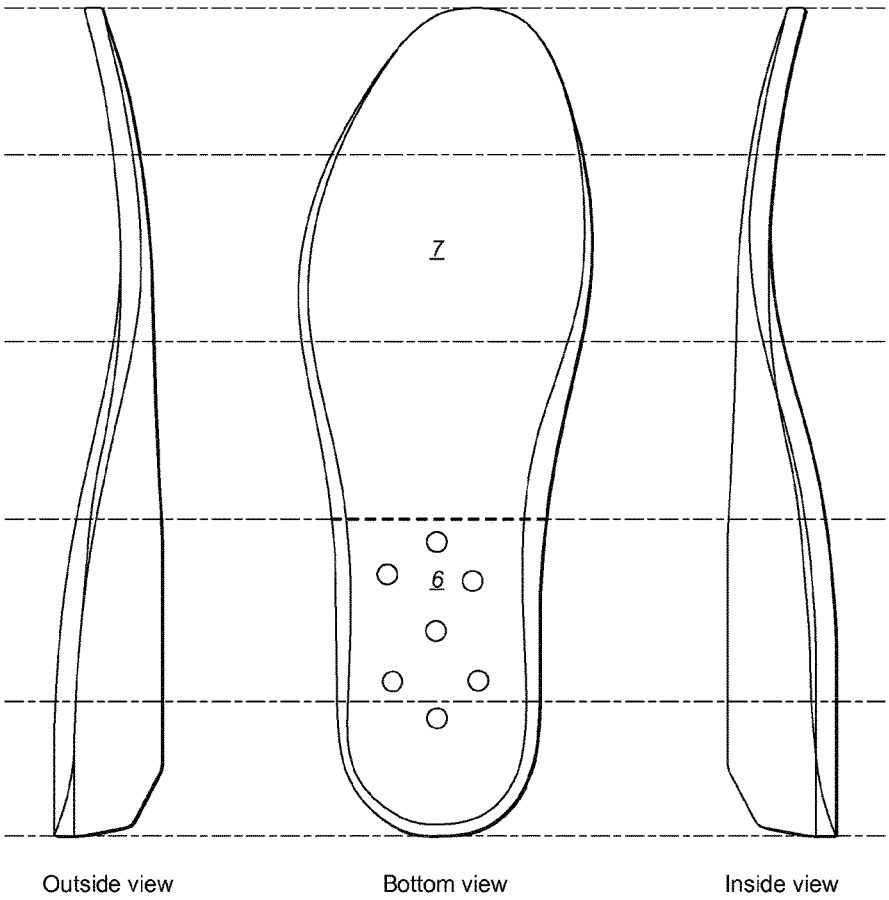
FIG. 2 shows a sole having two regions of different compressive resistances and/or flexibilities and/or densities.

In the following description, reference is made to lateral and longitudinal directions. The longitudinal direction in a sole for an item of footwear is intended to define the direction of a longest line joining the tip of the forward region 7 to the tip of the heel region 6 (as shown in FIG. 2). The lateral direction is defined as the direction perpendicular to the longitudinal direction.

Figure 1:
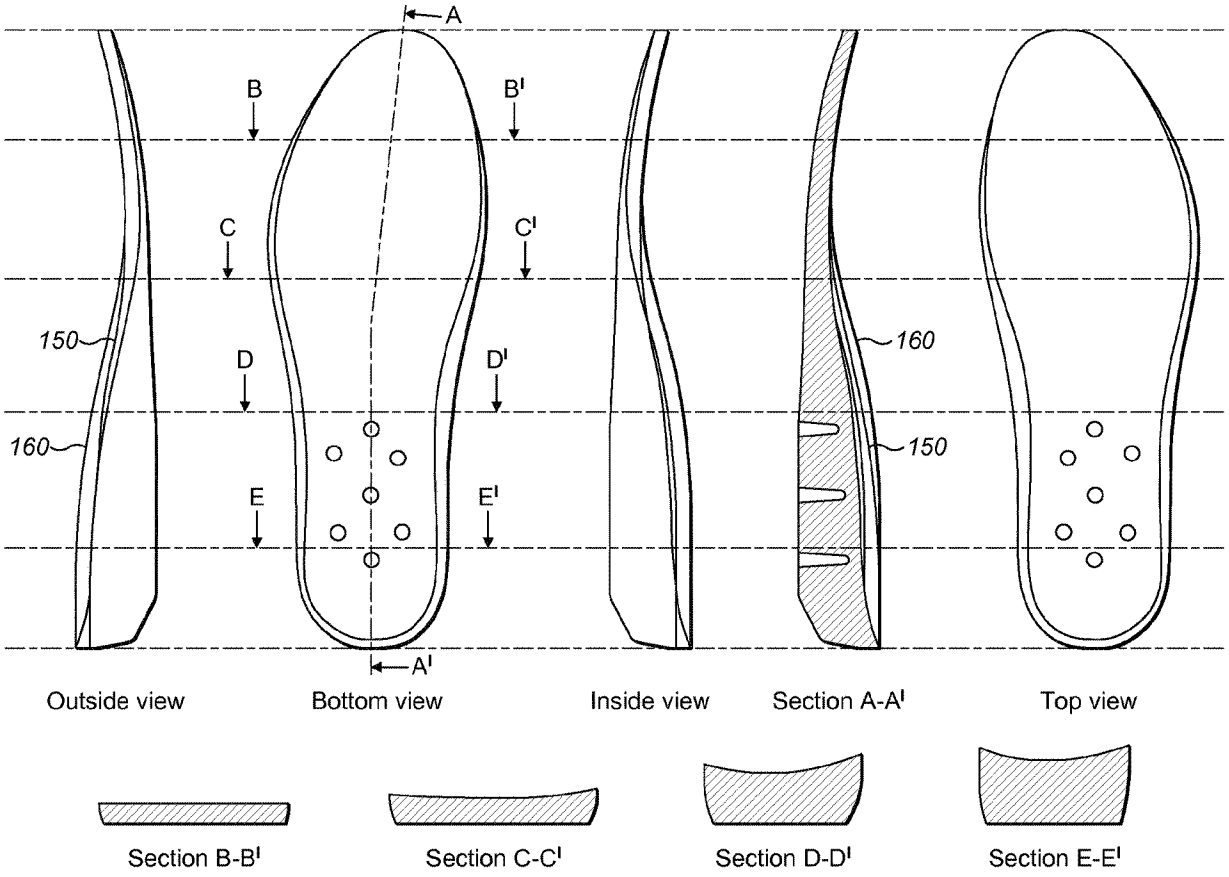
FIG. 1 shows side views and cross-sectional views of an item of footwear.

A first embodiment of the invention is shown in FIG. 1. As can be seen from Section B-B, the sole (or insole) has a flat upper surface when viewed in a cross-section in the lateral direction through the sole (i.e. the direction from the inside of the user's foot to the outside of the user's foot) near its front end.

In use, this laterally-flat portion of the upper layer of the sole or insole preferably supports the user's metatarsal bones. This laterally-flat portion may have a constant height in the lateral direction. It is believed that the disclosed arrangement of the sole or insole provides pressure reduction below the user's metatarsals, leading to a more comfortable item of footwear.

As can be seen from Section D-D and Section E-E, the sole (or insole) has a concave upper surface when viewed in a cross-section in the lateral direction through the sole (i.e. the direction from the inside of the user's foot to the outside of the user's foot) near its rear end.

In use, this concave portion of the upper layer of the sole or insole supports the user's heel bone. This heel-supporting portion has a height that varies in the lateral direction. When viewed in a cross-section in the lateral direction through the sole, this portion is concave, i.e. lower in the middle than at the edges.

Line 150 shows the centreline of the upper surface of the sole. Line 160 shows the outermost edge of the upper surface of the sole. As can be seen in FIG. 1, the centreline of the upper surface of the sole is lower in the vertical direction (when the item of footwear is placed normally on level ground) than the outermost edge over the heel-supporting portion. The centreline of the upper surface of the sole is level in the vertical direction (when the item of footwear is placed normally on level ground) with the outermost edge over the metatarsal-supporting portion.

In a preferred embodiment, the boundary between the laterally-flat portion and the concave portion is between 25% and 45% along the length of the sole from the foremost tip of the sole.

In a preferred embodiment, the laterally-flat portion extends over the foremost 37% of the length of the sole, and the concave portion will extend over the rearmost 63% of the length of the sole.

In a preferred embodiment, laterally-flat portion will extend forwardly of the foremost point of the user's inner longitudinal arch, and the concave portion will extend rearwardly of the rearmost point of the user's inner longitudinal arch. In the portion of the sole extending between the laterally-flat and concave portions (i.e. between the foremost point of the user's inner longitudinal arch and the rearmost point of the user's inner longitudinal arch), the sole may be flat, concave, or may transition between flat and concave.

In a preferred embodiment, the sole or insole will have a concave upper surface from the rearmost point along the length of the sole or insole up to the part of the sole or insole corresponding to the rearmost point of the user's inner longitudinal arch, and forwardly of the foremost point of the user's inner longitudinal arch the upper surface is flat in the lateral direction.

In preferred embodiments, the sole has an upper surface that in use contacts the foot of a user and a lower surface that in use contacts the ground. The thickness of the sole may be defined as the distance between the upper surface and lower surface. The sole thickness may be measured in a direction perpendicular to one of the upper and lower surfaces.

Preferably, the thickness of the sole is constant in the lateral direction in the laterally-flat portion; and the thickness of the sole varies in the lateral direction in the concave portion to thereby define a concave upper surface below the user's heel.

Preferably, the sole, or a mid-sole forming a layer of the sole, may be formed with two or more distinct regions, as can be seen in FIG. 2. A forward region is indicated by reference numeral 7. A heel region is indicated by reference numeral 6. The two regions of the sole are formed from materials of different compressive resistances and/or flexibilities and/or densities, with the forward region 7 being provided from a material of relatively lower compressive resistance and/or density and/or relatively higher flexibility. Thus the sole 2 is arranged to reduce pressure underfoot and provide comfort during application of a wearer's weight when walking.

The forward region 7 of the sole preferably comprises a first material of a first compressive resistance and/or density and/or flexibility. Further, the heel region 6 is of a second material of a compressive resistance higher than that of the first material and/or a density higher than that of the first material and/or a flexibility lower than that of the first material. By way of example, the hardness of the regions of the midsole can measured using the Asker C scale, the heel region 6 has an Asker C hardness of 63 to 69 and the forward region 7 has an Asker C hardness of 44 to 50. Preferably, the heel region 6 has an Asker hardness of 66 and the forward region 7 has an Asker C hardness of 47.

Figure 3:
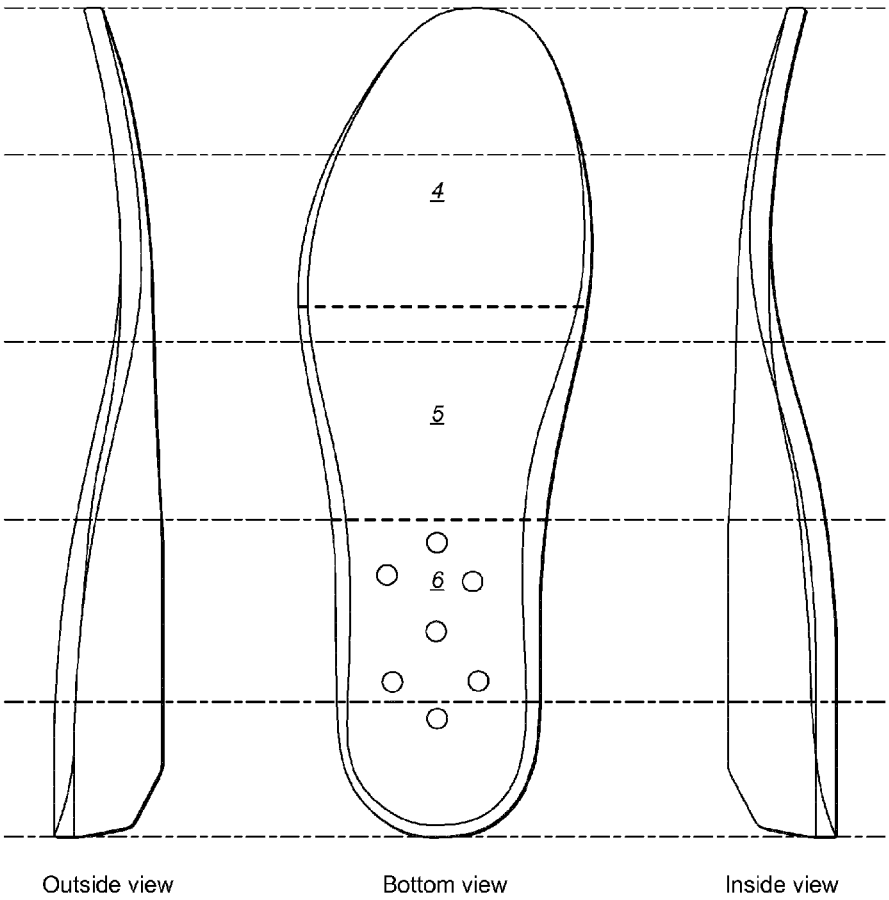
FIG. 3 shows a sole having three regions of different compressive resistances and/or flexibilities and/or densities.

Optionally, the sole, or a mid-sole forming a layer of the sole, may be formed with three distinct regions, as can be seen in FIG. 3. A frontal/toe region is indicated by reference numeral 4. A mid-foot region is indicated by reference numeral 5. A heel region is indicated by reference numeral 6. The three regions of the sole are formed from two or more materials of different compressive resistances and/or flexibilities and/or densities, with the mid-sole region 5 being provided from a material of least compressive resistance and/or density and/or greatest flexibility.

The mid-foot region 5 of the sole preferably comprises a first material of a first compressive resistance and/or density and/or flexibility; the frontal/toe region 4 comprises a second material of a compressive resistance higher than that of the first material and/or a density higher than that of the first material and/or a flexibility lower than that of the first material. Further, the heel region 6 is of a third material—different from the first and second materials—of a compressive resistance higher than that of the first material and/or a density higher than that of the first material and/or a flexibility lower than that of the first material. It is preferred that the sole 2 has a heel region 6 and a frontal/toe region both harder than the mid-foot region 5. In also preferred that the frontal/toe region 4 is slightly softer than the heel region 6, but with both the heel region 6 and the frontal/toe region 4 harder than the mid-foot region 5. By way of example, the hardness of the regions of the midsole can be measured using the Asker C scale, the heel region has an Asker C hardness of 63 to 69, the mid-foot region an Asker C hardness of 42 to 48, and the frontal/toe region an Asker C hardness of 45 to 51. Preferably, the heel region has an Asker C hardness of 66, the mid-foot region on Asker C hardness of 45, and the frontal/toe region an Asker C hardness of 48.

In preferred embodiments of an item of footwear 1 according to the present invention, the frontal/toe region 4 extends over the forwardmost 15% to 24% of the length of the sole 2, preferably around 18%, the mid-foot region 5 extends over the middle 37% to 53% of the length of the sole 2, preferably over the middle 47% to 53% of the length of the sole 2 and most preferably around 50%, and the heel region 6 extends over the rearmost 29% to 39% of the length of the sole 2, preferably around 32%.

It is not essential that any of the regions of different density correspond exactly with either metatarsal-supporting portion or the heel-supporting portion.

However, in some embodiments, the part of the sole having an upper surface that is flat in the lateral direction may correspond with the frontal/toe region, whilst the concave part of the sole may correspond with the heel region. In the arch region, the sole may be flat, concave, or may transition between flat and concave.

Although the item of footwear described above may form an open shoe (e.g. a sandal or flip-flop), or a closed shoe, the inventors have found that the sole is preferably configured differently in each type of footwear. Specifically, it has been found that the maximum width of the sole for a closed shoe should be narrower than for an equivalent open shoe, despite the heel width being the same.

Preferably, the maximum width of the sole should be between 25% and 35% greater than the heel width in a closed shoe and between 35% and 45% greater than the heel width in an open shoe.

The heel width is defined as the maximum lateral dimension of the sole in the heel region (i.e., the rearmost 29% to 39% of the length of the sole 2, preferably the rearmost 32% of the length of the sole).

The sole is preferably a single unitary block of material. Preferably, the material is compressible.

The sole preferably comprises ethylene vinyl acetate (EVA). In embodiments having regions of different compressive resistance and/or density and/or flexibility, one, two, or all of the regions may be formed of EVA (EVA can be manufactured to have a desired compressive resistance and/or density and/or flexibility).

However, it will be understood that other materials will provide an equivalent effect and examples of those materials are other elastomers, silicones, natural or synthetic rubbers and/or polyurethanes.

Figure 4:
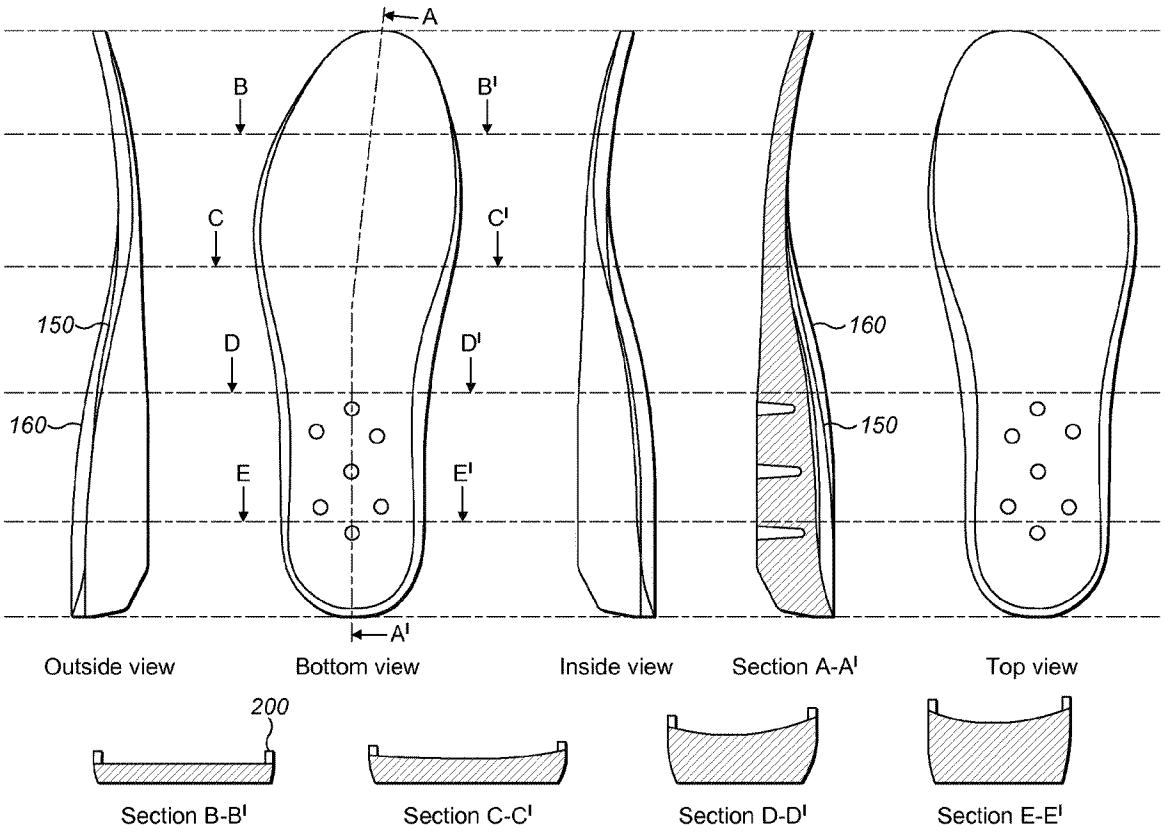
FIG. 4 shows an alternative item of footwear to that of FIG. 1.

An alternative variant of any of the embodiments set out above is shown in FIG. 4. As can be seen most clearly from the cross-sections, a wall 200 may be provided. Wall 200 may be integral with the sole (or insole).

In such a variant, the forward region 7 upon which a user's foot is to be supported extends within the wall 200 forwardly of the part of the sole corresponding to the foremost end of the user's longitudinal arch. Thus, the upper surface of the sole in the forward region 7 is substantially flat and is surrounded by the wall.

The invention claimed is:

1. A shoe comprising:

a sole comprising a unitary body having an upper surface that in use contacts the foot of a user and a lower surface that in use contacts the ground, wherein:

the upper surface has a first portion and a second portion, the first portion located forwardly of the second portion;

the upper surface is substantially flat in the lateral direction in the first portion;

the upper surface is concave in the lateral direction in the second portion; and the sole has a frontal/toe region, a mid-foot region and a heel region, the mid-foot region of the sole being formed of a material different from a material from which the heel region is formed, wherein the material of the mid-foot region has a lower compressive resistance and/or a lower density and/or a higher flexibility than the material of the heel region;

wherein the shoe is selected from the group consisting of a closed shoe and an open shoe.

2. The shoe of claim 1, wherein the first portion is adapted to support the user's metatarsal bones and the second portion is adapted to support the user's heel.

3. The shoe of claim 1, wherein the sole has a thickness that varies by less than 10% in the lateral direction in the region of the sole that supports the user's metatarsal bones.

4. The shoe of claim 1, wherein the upper surface is concave in the lateral direction in the heel region of the sole.

5. The shoe of claim 1, wherein the sole has a thickness that is constant in the frontal/toe region of the sole.

6. The shoe of claim 1, wherein:

the sole has a forward region extending up to the heel region;

the forward region of the sole is formed from a material having a lower compressive resistance and/or a lower density and/or a higher flexibility than a material forming the heel region of the sole.

7. The shoe of claim 6, wherein:

the heel region corresponds with the portion of the sole that supports the user's heel; and the forward region corresponds with the region of the sole that supports the user's metatarsal bones.

8. The shoe of claim 1, wherein the frontal/toe region is formed from a material having higher compressive resistance and/or higher density and/or lower flexibility than the mid-foot region.

9. The shoe of claim 1, wherein the heel region corresponds with the portion of the sole that supports the user's heel.

10. The shoe of claim 1, wherein:

the shoe is a closed shoe; and the sole has a maximum width that is between 25% and 35% greater than the maximum width of the heel region of the sole.

11. The shoe of claim 1, wherein:

the shoe is an open shoe; and the sole has a maximum width that is between 35% and 45% greater than the maximum width of the heel region of the sole.

12. The shoe of claim 1, wherein the sole is compressible.

13. The shoe of claim 1, wherein the sole comprises ethylene vinyl acetate.

14. The shoe of claim 1, wherein a wall extends from the sole, surrounding the upper surface.

* * * * *